US010914102B2

(12) United States Patent
Hunt

(10) Patent No.: US 10,914,102 B2
(45) Date of Patent: Feb. 9, 2021

(54) MOTOR VEHICLE DOOR LATCH

(71) Applicant: Kiekert AG, Heiligenhaus (DE)

(72) Inventor: Robert J. Hunt, Davisburg, MI (US)

(73) Assignee: Kiekert AG, Heiligenhaus (DE)

( * ) Notice: Subject to any disclaimer, the term of this patent is extended or adjusted under 35 U.S.C. 154(b) by 452 days.

(21) Appl. No.: 15/846,718

(22) Filed: Dec. 19, 2017

(65) Prior Publication Data

US 2018/0171681 A1 Jun. 21, 2018

Related U.S. Application Data

(60) Provisional application No. 62/436,135, filed on Dec. 19, 2016.

(51) Int. Cl.
*E05B 81/20* (2014.01)
*E05B 81/14* (2014.01)
*E05B 81/40* (2014.01)

(52) U.S. Cl.
CPC ..... *E05B 81/20* (2013.01); *E05B 81/14* (2013.01); *E05B 81/15* (2013.01); *E05B 81/40* (2013.01); *Y10T 292/1082* (2015.04)

(58) Field of Classification Search
CPC ..... Y10T 292/1082; Y10T 292/308; Y10T 292/1047
See application file for complete search history.

(56) References Cited

U.S. PATENT DOCUMENTS 4,135,377 A * 1/1979 Kleefeldt ..... E05B 81/25 292/144
4,395,064 A * 7/1983 Bellot ..... E05B 81/20 292/201
4,624,491 A * 11/1986 Vincent ..... E05B 81/06 185/40 R
4,927,204 A * 5/1990 Asada ..... E05B 81/20 292/216
6,003,910 A * 12/1999 Dupont ..... E05B 81/14 292/201
6,059,327 A * 5/2000 Yoshikuwa ..... E05B 83/16 292/216
6,079,237 A * 6/2000 Hochart ..... E05B 81/14 292/201

(Continued)

FOREIGN PATENT DOCUMENTS

DE 3414475 * 12/1985
DE 198 28 040 A1 12/1999

(Continued)

*Primary Examiner* — Carlos Lugo
(74) *Attorney, Agent, or Firm* — Renner, Otto, Boisselle & Sklar, LLP

(57) ABSTRACT

A motor vehicle door latch, in particular a servo latch, which is equipped with a locking mechanism including of a catch and a pawl. Furthermore, a spindle drive with a motor, spindle and spindle nut located thereon is executed at least to close the locking mechanism. The spindle nut impinges the catch at least in the closure direction via a closure lever. The closure lever is simultaneously formed as an opening lever to open the locking mechanism and consequently as a combined closure/opening lever. The combined closure/opening lever impinges either the catch in a closing direction or the pawl in an opening direction dependent on the actuating direction of the spindle drive.

15 Claims, 5 Drawing Sheets

(56) References Cited

U.S. PATENT DOCUMENTS

| | | | | |
|---|---|---|---|---|
| 6,267,420 | B1 * | 7/2001 | Miyagawa | E05B 83/16 292/216 |
| 6,407,520 | B1 * | 6/2002 | Kleefeldt | E05B 77/48 292/201 |
| 6,557,910 | B2 * | 5/2003 | Amano | E05B 81/14 292/201 |
| 6,575,507 | B2 * | 6/2003 | Reddmann | E05B 81/14 292/201 |
| 6,685,239 | B2 * | 2/2004 | Yamauchi | E05B 81/20 292/144 |
| 6,997,488 | B2 * | 2/2006 | Kurten | E05B 81/14 292/201 |
| 7,475,920 | B2 * | 1/2009 | Bigazzi | E05B 81/14 292/201 |
| 2001/0010427 | A1 | 8/2001 | Roos et al. | |
| 2004/0056489 | A1 | 3/2004 | Boecker et al. | |
| 2004/0174021 | A1 | 9/2004 | Tensing et al. | |
| 2008/0224482 | A1 * | 9/2008 | Cumbo | E05B 77/02 292/216 |
| 2011/0012380 | A1 | 1/2011 | Bendel et al. | |
| 2011/0074168 | A1 | 3/2011 | Bendel et al. | |

FOREIGN PATENT DOCUMENTS

| | | | |
|---|---|---|---|
| DE | 100 15 596 | A1 | 10/2001 |
| DE | 102 16 845 | A1 | 11/2003 |
| DE | 20 2008 007 296 | U1 | 6/2009 |
| DE | 10 2008 009 506 | A1 | 8/2009 |
| EP | 1 404 936 | B1 | 4/2004 |

* cited by examiner

MOTOR VEHICLE DOOR LATCH

This application claims priority to U.S. Provisional Patent Application No. 62/436,135 filed Dec. 19, 2016, which is hereby incorporated herein by reference in its entirety.

The invention relates to a motor vehicle door latch, in particular a servo latch, with a locking mechanism predominantly comprising a catch and a pawl, with a spindle drive with a motor, spindle and a spindle nut located thereon, at least to close the locking mechanism, whereby the spindle nut at least impinges the catch in the closure direction via a closure lever.

BACKGROUND

Motor vehicle door latches and, in particular, servo latches generally possess an electromotor, with the aid of which the relevant motor vehicle door latch and consequently a door or flap equipped herewith can be closed, for example. During closure, the general procedure is that the locking mechanism fundamentally comprising a catch and a pawl is transferred into its end position or main ratchet position after reaching a certain functional position, usually the pre-ratchet position. In principle, assumption of a so-called overstroke position is also possible. However, such motor vehicle door latches have been tried and tested because an operator only needs to move the pertaining door or flap into the pre-ratchet position. The closure drive or spindle drive then ensures the complete closure process. This is convenient.

In the case of the motor vehicle door latch of the construction described above according to DE 20 2008 007 296 U1, a linear drive is executed which demonstrates a spindle and a spindle nut. The linear drive works on a closure pawl with the aid of a lever gearbox. For its part, the closure pawl engages into a contour of the catch. Such a procedure both requires a great deal of constructional effort and is unable to accumulate especially high closure forces. It is a similar case for DE 10 2008 009 506 A1.

In addition to this class-specific state of the art, in the literature execution forms are described in which closure and opening of the locking mechanism is accomplished with the aid of a single drive. Examples of such motor vehicle door latches are introduced in DE 198 28 040 A1, DE 102 16 845 A1 or also EP 1 404 936 B1. Absolutely no linear drives are used as drives.

Once again, mechanically complex constructions are necessary to be able to execute both the closure function and the opening function. Thus, the theory works according to DE 198 28 040 A1 with a control disc which interacts with pertaining stop elements both on the pawl and the catch during the opening or closure process.

In DE 102 16 845 A1 two couplings are used, whereby the drive there impinges a cog which is operatively connected to the two couplings. In the activation of the drive in a first drive direction, the first coupling is impinged to activate a first function and on activation of the drive in its second drive direction the second coupling is impinged to activate a second function of the locking mechanism.

The theory according to EP 1 404 936 B1 which is equipped with a first output element as an opening aid and a second output element as a closure aid may be worth mentioning. The first output element works on the pawl, while the second output element acts on the catch as a closure aid.

The final theory to be mentioned DE 100 15 596 A1 relates to a motor vehicle door latch in which a knee lever arrangement is provided for between an actuator drive and a linearly adjustable closure element. The knee lever arrangement can be transferred into its self-locking holding position from a bent position via a stretched position. The closure element is a U-shaped locking bracket which is arranged on a base plate which is linearly displaceable.

The state of the art cannot satisfy in all aspects. Complicated mechanics are often present in order to enable both a locking or closure function of the locking mechanism and an opening of the locking mechanism. Added to this is the fact that the previously known execution forms are limited with regard to their transferrable forces, in particular for the closure process. This is where the invention as a whole wishes to provide assistance.

The invention provides a motor vehicle door latch in such a way that great forces and, in particular, great closure forces can be transferred with a simple construction.

With a class-specific motor vehicle door latch the invention proposes that the closure lever is simultaneously formed as an opening lever for opening of the locking mechanism and consequently as a combined closure/opening lever, whereby the combined closure/opening lever either impinges the catch closed or the pawl open according to the actuating direction of the spindle drive.

Within the scope of the invention, work initially consciously takes place with a linear drive or a spindle drive with a (single) motor, a spindle and a spindle nut located thereon. With the aid of this spindle drive the combined closure/opening lever is now impinged. The combined closure/opening lever is advantageously a pivoting lever. This pivoting lever is also generally located on the same axis as the catch.

Furthermore, the general procedure is that the combined closure/opening lever is connected to the spindle nut at one end with a swivel joint and at its other end is located in a pivoting movement on the common axis with the catch. Location of the combined closure/opening lever on the same axis as the catch means that a closure process of the locking mechanism can be accomplished especially simply from a functional viewpoint. Usually it is only necessary for the combined closure/opening lever to interact with a stop on the catch. The relevant closure/opening lever is advantageously equipped with a pivotable stop element located thereon.

The stop element is pivoted or conducted with the aid of a conducting element. The conducting element is of a static design or affixed to the housing. Thus, the stop element is generally either pivoted in the direction of the pawl or the direction of the catch around its axis on the combined closure/opening lever starting from a neutral position of the spindle drive with the aid of the relevant conducting element dependent on the actuator direction of the spindle drive. The aforementioned neutral position of the spindle drive is generally assumed in a spring-assisted manner. In fact, according to an advantageous and preferred design, the invention envisages that the neutral position of the spindle drive is only assumed in a spring-assisted manner. i.e. any motorized actuator movement of the spindle drive into the neutral position is neither envisaged nor intended.

Instead, the spindle drive has at least one opening/resetting spring to assume the neutral position at least following an opening process of the locking mechanism. Consequently, the relevant opening/resetting spring ensures that the spindle drive is solely reset by the force of the relevant opening/resetting spring into the neutral position following the stated opening process. The opening/resetting spring is usually compressed on transfer of the spindle drive from the neutral position into an opening position. After the opening process has taken place, the motor is switched off, for example, as a component of the spindle drive. The force of the opening/resetting spring compressed into the opening position then ensures that the spindle drive assumes the neutral position (again). This applies even if the drive has broken down or mechanical impairments of the spindle drive need to be overcome.

Therefore, within the scope of the invention the neutral position is assumed again in any case after the described opening process of the locking mechanism, even when the motor or the spindle drive in general has broken down and even if the spindle drive is mechanically impaired by a defect. This is ensured by the powerful opening/resetting spring which has previously been compressed in the opening position. However, a relaxation of the opening/resetting spring compressed in the opening position leads to the spindle drive compulsorily being reset to the neutral position.

Thus, a subsequent closure process of the locking mechanism is easily possible, even when the spindle drive is broken down as described. This leads to an enormous increase in safety, especially as the neutral position is assumed purely mechanically by the force of the opening/resetting spring.

The opening/resetting spring is generally arranged between a stop on the motor side and a stop on the spindle nut side. In order to assume the opening position, the stop on the spindle nut side and the spindle nut travel in the direction of the stop on the motor side. As soon as the stop on the spindle nut side has reached the stop on the motor side with compression of the opening/resetting spring, the opening position is assumed and the combined closure/opening lever is able to lift the pawl from its engagement with the catch. As a consequence hereof, the catch generally pivots in a spring-assisted manner and a previously caught locking bolt is released. This is the usual functionality with a motorized opening process of a locking mechanism.

Following this opening process, the spindle drive is compulsorily and mechanically transferred into its neutral position with the aid of the opening/resetting spring. In this neutral position, the pawl is free of the combined closure/opening lever. The pawl can therefore engage into the catch to secure it as soon as the pivoted catch is moved by the locking bolt entering, for example. This guarantees maximum safety.

In addition to the aforementioned opening/resetting spring, a closure/resetting is usually also provided for to assume the neutral position at least after a closure process of the locking mechanism. While the opening/resetting spring is arranged between the stop on the motor side and the stop on the spindle nut side and so to speak incorporates the spindle in the center, the closure/resetting spring is generally connected to the spindle on the end side.

The opening/resetting spring is generally a coil spring which surrounds the spindle nut which is arranged centrally in contrast and is held between the stop on the motor side and stop on the spindle nut side. In contrast, the closure/resetting spring is generally designed as a spiral spring. Thus, the closure/resetting spring can be connected to the end side of the spindle. Furthermore, the design is usually such that the opening/resetting spring is at least partly plunged or can be plunged into a gearbox or a gearwheel as a component of the spindle drive. The gearwheel is set in motion by the motor or electromotor. As the gearwheel is connected to the spindle in a torque-proof manner, the spindle follows the rotations thus generated. At the same time, an especially compact and small construction is achieved by the concentric arrangement of the opening/resetting spring compared to the spindle as well as by the concentric arrangement of the closure/resetting spring compared to the spindle in conjunction with the gearwheel partly incorporating the opening/resetting spring.

Weight advantages are also observed in conjunction with the only combined closure/opening levers driven with the aid of the spindle nut with the stop element located thereon. Furthermore, the functionality is improved compared to previous execution forms because only the spindle nut is moved both for the opening process and also for the closure process and the linear movement of the spindle nut corresponds to a pivoting movement of the combined closure/opening lever. The pivoting movement leads to an opening of the locking mechanism in one actuating direction of the spindle drive in which the stop element lifts the pawl from its engagement with the catch. In the other actuating direction of the spindle drive, the stop element interacts with the stop on the catch to ensure the catch is closed. The locking mechanism is generally located in its pre-ratchet position. Due to the pivoting movement of the combined closure/opening lever, the catch is pivoted in the direction of the main ratchet position of the locking mechanism during the closure process.

As a result, a motor vehicle door latch is provided which is not only especially compact and guarantees functionally reliable operation. But the fallback on the spindle drive which, in turn, impinges the combined closure/opening lever located coaxially to the catch according to its actuating direction also provides especially great closure forces of up to approximately 1000 Newtons. This is principally attributable to the fact that the spindle nut touches the abaxial end of the relevant closure/opening lever and consequently can generate a great torque. Added to this is the fact that the only combined closure/opening lever can be configured long and stiff both for the opening process and the closure process in order to be able to generate especially great closure forces. The stiff design of the closure/opening lever can be executed by it being formed as a flat lever with its width expansion in the direction of the touching force and consequently in the direction of the spindle.

Furthermore, the design is usually such that the opening/resetting spring is equipped with a greater spring constant than the closure/resetting spring. For example, the spring constant of the opening/resetting spring may be designed at least two or three times the size of the spring constant of the closure/resetting spring. This assumes that considerably greater forces need to be applied by the spindle drive for the closure process of the locking mechanism than necessary for the opening of the locking mechanism. As a consequence hereof, the opening process of the locking mechanism corresponds to the opening/resetting spring being compressed with a greater spring constant and thus considerable resetting forces are available after ending of the opening process. These significant resetting forces ensure that the spindle drive assumes the neutral position as described in any case.

Although the closure/resetting springs are also compressed or impinged in principle in the described opening process, due to its lower spring constant compared to the opening/resetting spring it is unable to work against the closure/resetting spring. Because the opening/resetting spring is measured and set by its spring constant in such a way that only frictional forces of the spindle drive can be overcome hereby.

As the opening/resetting spring is only compressed during an opening process and the opening/resetting spring does not impinge the combined closure/opening lever during a closure process, the maximum force applied by the spindle drive is provided for such a closure process. In the relevant closure process, only the closure/resetting spring is tensioned with a low spring constant and after ending of the opening process ensures that the spindle drive is returned to the neutral position. These are the significant advantages.

BRIEF DESCRIPTION OF THE DRAWINGS

Hereinafter, the invention is explained in further detail on the basis of a sketch which only depicts an execution example. It shows.

DETAILED DESCRIPTION OF AN EXEMPLARY EXECUTION

Figure 1:
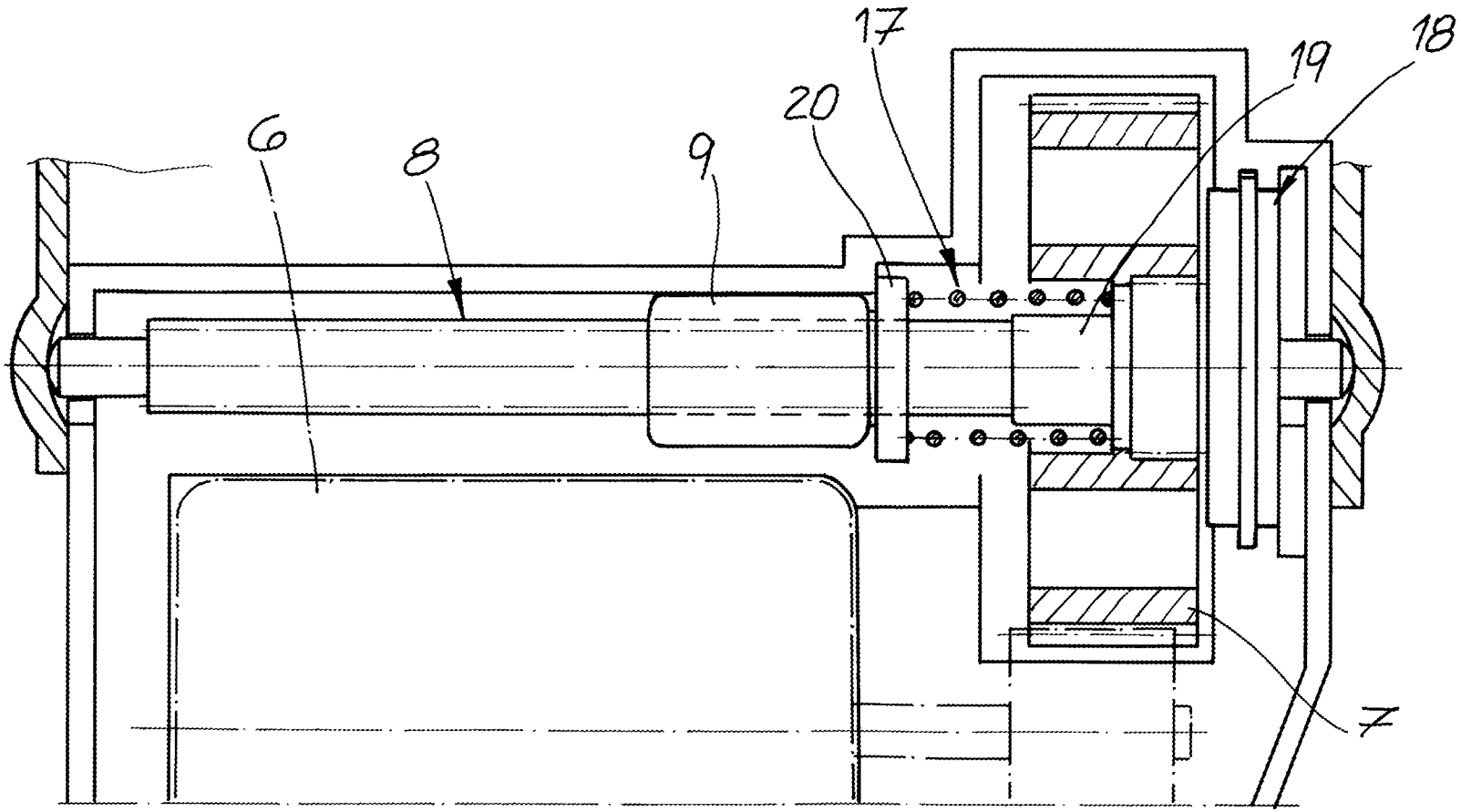
FIG. 1 the motor vehicle door latch according to the invention.

In the figures a motor vehicle door latch is depicted which involves a servo latch which is equipped with a drive for this purpose. The drive works on a locking mechanism 1, 2 comprising a catch 1 and a pawl 2. The catch 1 is pivotably located around an axis 3. A similar scenario applies to the pawl 2 which accomplishes or can accomplish rotation around an axis 4. Both axes 3, 4 are defined by respective bolts or joint bolts which are anchored in a latch case only depicted in FIG. 2 or a latch sheet 5.

The drive formed as a spindle drive 6, 7, 8, 9 pertains to the basic construction. In fact, the spindle drive 6, 7, 8, 9 according to the execution example has a (single) motor 6, a gearwheel 7, a spindle 8 and a spindle nut 9 located on the spindle 8. On the basis of FIG. 1, it can be ascertained that the motor 6 and the spindle 8 are arranged in parallel and in the same lengthwise extension for the purpose of compact construction.

Figure 2:
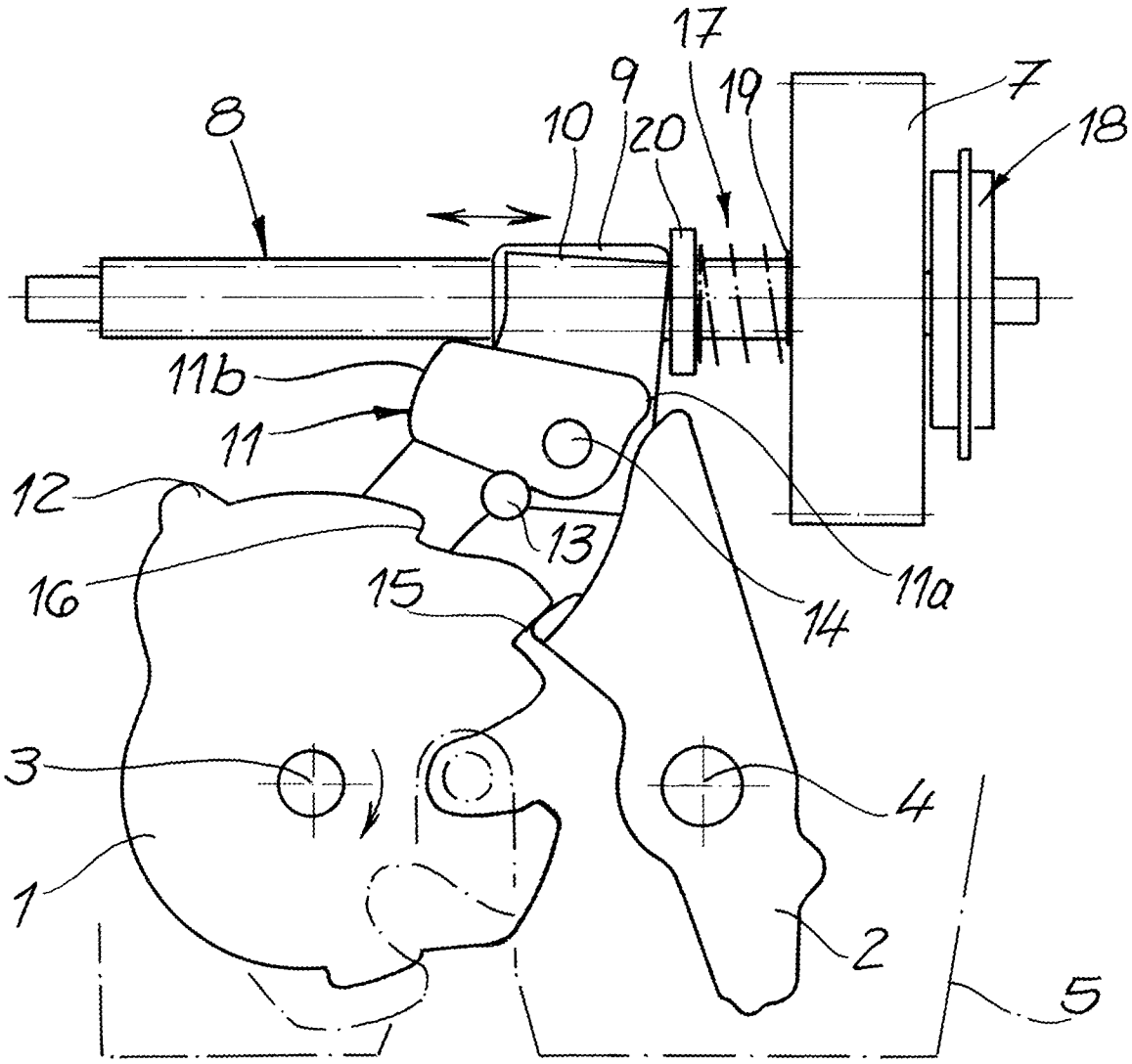
FIG. 2 an excerpt from FIG. 1 reduced to the spindle drive and the locking mechanism in the neutral position of the spindle drive, FIG. 3 the object according to FIG. 2 in an opening process, FIG. 4 the object according to FIG. 2 at the start of a closure process and FIG. 5 the complete closure process following the functional representation in FIG. 4.

On the basis of the principle sketch according to FIG. 2, it is furthermore recognized that the motor 6 designed as an electromotor is equipped with an output shaft which demonstrates an output gearwheel. The output gearwheel of the (only) motor 6 is combed with a gearbox wheel 7. Thus, the output gearwheel and the gearwheel 7 in the execution example form a reduction gearbox, which of course is only an example and is not compulsory.

Figure 4:
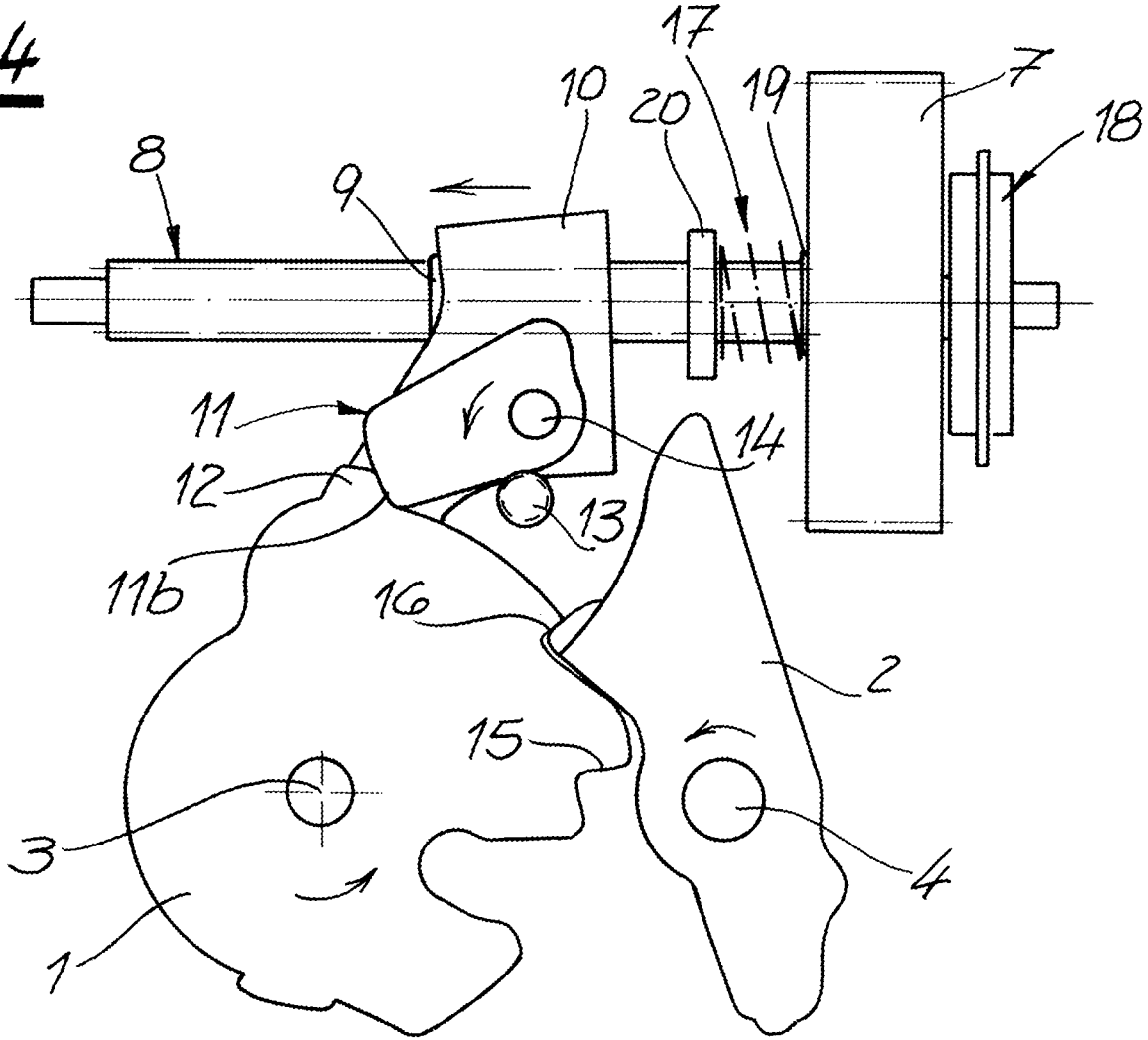
Figure 5:
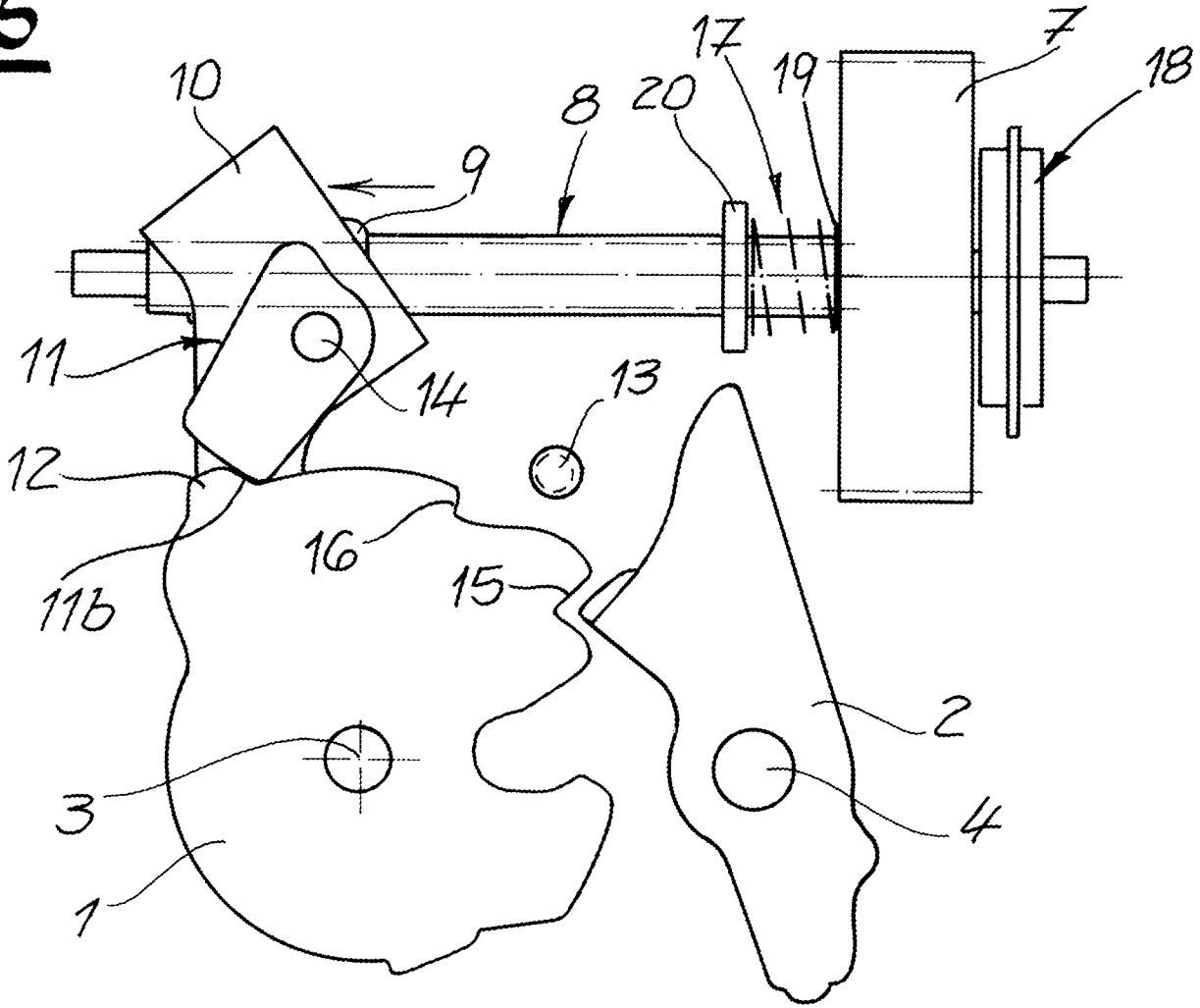

The gearwheel 7 is connected to the spindle or threaded spindle 8 in a torque-proof manner. Thus, rotational movements of the motor or electromotor 6 can be transferred via the gearwheel 7 to the spindle 8. Rotations of the spindle 8 now lead to the spindle nut 9 located on the spindle 8 being able to execute the linear movements depicted in FIG. 2. The neutral position or park position of the spindle drive 6, 7, 8, 9 is depicted in FIG. 2. Starting from this neutral position, the spindle drive 6, 7, 8, 9 both ensures that the locking mechanism 1, 2 can be opened as depicted in FIG. 3 and that the locking mechanism 1, 2 can also be closed with the aid of the spindle drive 6, 7, 8, 9 as depicted in FIGS. 4 and 5.

Figure 3:
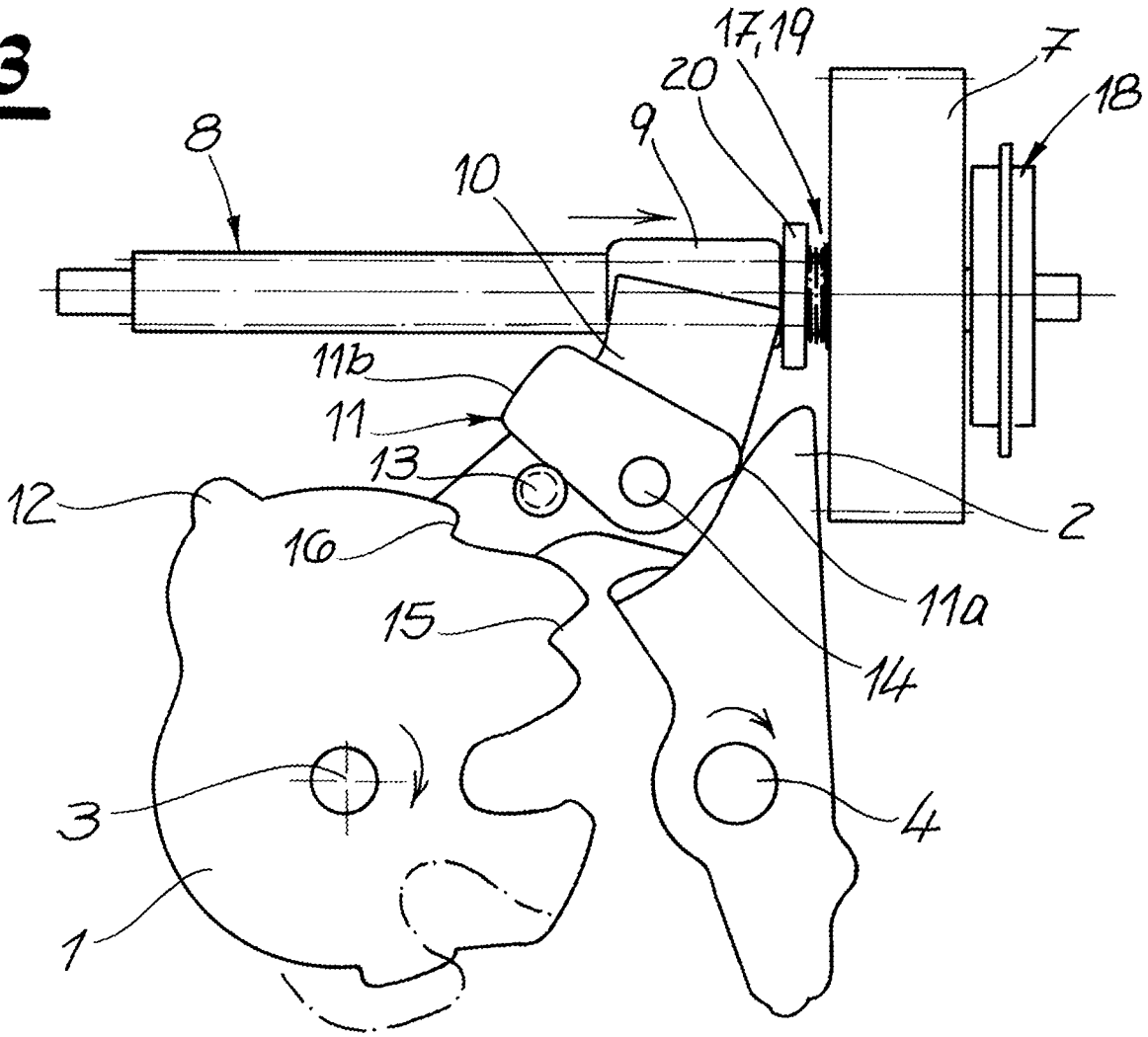

A movement of the spindle drive 6, 7, 8, 9 or the spindle nut 9 starting from the neutral position according to FIG. 2 to the right corresponds to the opening process of the locking mechanism 1, 2, as made clear in a comparison of FIGS. 2 and 3. An arrow in FIG. 3 depicts this. A (first) actuating direction of the spindle drive 6, 7, 8, 9 corresponds to this.

In addition to this opening process however, a closure process of the locking mechanism 1, 2 with the aid of the spindle drive 6, 7, 8, 9 can also be depicted. A movement of the spindle nut 9 to the left starting from the neutral position corresponds to this. This is depicted in FIGS. 4 and 5 and is assisted by a relevant movement arrow which depicts the other (second) actuating direction of the spindle drive 6, 7, 8, 9. FIG. 5 finally shows the complete closure process. The closure process of the locking mechanism 1, 2 depicted in FIGS. 4 and 5 occurs again starting from the neutral position according to FIG. 2.

The spindle nut 9 located on the spindle 8 impinges the catch 1 via a closure lever 10, 11 for this purpose, at least in the closure direction or the pawl 2 at least in the opening direction. In fact, the relevant closure lever 10, 11 according to the invention is one which is not only suitable and designed as an opening lever 10, 11 to close the locking mechanism 1, 2 but also opens the locking mechanism 1, 2. Consequently, the relevant closure lever 10, 11 or opening lever 10, 11 is designed as a combined closure/opening lever 10, 11 according to the invention.

The combined closure/opening lever 10, 11 impinges either the catch 1 closing or the pawl 2 opening dependent on the actuating direction of the spindle drive 6, 7, 8, 9. i.e. the sole motor 6 of the spindle drive 6, 7, 8, 9 ensures that the spindle drive 6, 7, 8, 9 is either moved in the first actuating direction or the second actuating direction. According to this actuating direction, the spindle nut 10 impinges a single and combined closure/opening lever 10, 11, which is responsible both for opening the locking mechanism 1, 2 and also for closing the locking mechanism 1, 2. That depends on the actuating direction of the spindle drive 6, 7, 8, 9.

In fact, in the execution example the design is such that the combined (sole) closure/opening lever 10, 11 is formed coaxially to the pivoting lever 10, 11 located on the catch 1 or demonstrates such. i.e. the combined closure/opening lever 10, 11 uses the axis 3 concurring with the catch 1 for its pivoting movements.

To this end, the combined (sole) closure/opening lever 10, 11 is connected to the spindle nut 9 with a rotating joint at one end. Its other end is pivotably located on the common axis 3 with the catch 1. Furthermore, it is recognized on the basis of the figures that the relevant combined and sole closure/opening lever 10, 11 is a flat lever 10 or the closure/opening lever 10, 11 demonstrates such a flat lever or a general lever 10. The width extension of the relevant flat lever 10 is thus oriented in the actuating direction or coincides with the drawing plane. Thus, any forces transmitted with the aid of the spindle nut 9 on the closure/opening lever 10, 11 touch in the respective actuating direction along the wide side of the flat lever 10 which is consequently especially stiff in this force direction. Thus, great forces can be transmitted, whereby closure forces of up to 1000 Newtons are possible, for example.

Such great closure forces can be transmitted with the aid of the described spindle drive 6, 7, 8, 9 onto the locking mechanism 1, 2 or the catch 1 and are especially advantageous in view of the fact that nowadays, for example, rubber door seals accumulate especially great resetting forces during such a closure process for convenience reasons and to minimize vehicle noises as far as possible.

The closure/opening lever 10, 11 comprises the actual lever or flat lever 10 and a stop element 11 pivotably located on the lever 10. Dependent on the actuating direction of the spindle drive 6, 7, 8, 9, the stop element 11 interacts either with the pawl 2 or with a stop 12 on the catch 1. In fact, the stop element 11 is pivoted with the aid of a static conducting element 13 for this purpose. The static conducting element 13 may be a conducting bolt 13 which is connected to a latch cover or a latch housing sealing the latch case 5 on the upper side or which constitutes a component thereof, which is not shown in greater detail however.

By the conducting of the stop element 11 and its pivotable location on the lever or flat lever 10 with the definition of a pertaining axis or rotational axis 14 the relevant stop element 11 either pivots in the direction of the pawl 2 or in the direction of the catch 1 around the relevant axis 14 on the closure/opening lever 10, 11 or the flat lever 10 starting from the neutral position of the spindle drive 6, 7, 8, 9 according to FIG. 2 pivots with the aid of the conducting element or conducting bolt 13 according to the actuating direction of the spindle drive 6, 7, 8, 9. This is recognized in the transition from FIG. 2 to FIG. 3 or in the transition from FIG. 2 to FIG. 4.

In fact, the transition from the neutral position according to FIG. 2 to FIG. 3 corresponds to the spindle drive 6, 7, 8, 9 being impinged to open the locking mechanism 1, 2 and hereby the spindle nut 9 moving to the right as depicted in FIG. 3. The consequence of this is that the combined closure/opening lever 10, 11 is pivoted in the clockwise direction indicated in FIG. 3 in the transition from FIG. 2 to FIG. 3. Thus, the stop element 11 distanced from the pawl 2 in the neutral position becomes adjacent to the pawl 2. For this purpose, the stop element 11 possesses a relevant stop surface 11*a*. In addition to this stop surface 11*a* interacting with the pawl 2 during the opening process, the stop element 11 also has a further stop surface 11*b* opposite to the axis 14 which is viewed in further detail below.

The opening process now results in the relevant stop surface 11*a* of the stop element 11 moving against the pawl 2. At the same time, the stop element 11 experiences the described pivoting movement in a clockwise direction around its axis 14. Because in the relevant transition from FIG. 2 to FIG. 3 the stop element 11 is moved along the conducting bolt 13 and pivoted around its axis 14 in the execution example in a clockwise direction in the direction of the pawl 2.

Because the stop element 11 moves against the pawl 2 with its stop surface 11*a* at the abaxial end, the pawl 2 is lifted from its engagement into the catch 1. Thus, the pawl 2 executes the clockwise direction movement around its axis 4 indicated in FIG. 3. The pawl 2 previously engaged in a main ratchet 15. The main ratchet position of the locking mechanism 1, 2 as shown in FIG. 2 corresponds to this. In addition, the locking mechanism 1, 2 can also assume a pre-ratchet position as depicted in FIG. 4. Then the pawl 2 engages into a pre-ratchet 16.

In addition to the opening process outlined and consequently the transition of the spindle drive 6, 7, 8, 9 from the neutral position according to FIG. 2 to the opening position of the locking mechanism 1, 2 in FIG. 3, the spindle drive 6, 7, 8, 9 can also be impinged in such a way that the relevant locking mechanism 1, 2 is closed. The closing process depicted in FIGS. 4 and 5 and the ultimately attained closure position according to FIG. 5 corresponds to this.

In order to accomplish such a closure process, the spindle drive 6, 7, 8, 9 is impinged in the second actuating direction, in the present case in the transition from the neutral position according to FIG. 2 at the start of the closure process according to FIG. 4 in such a way that the spindle nut 9 is moved to the left. As a consequence hereof, the combined closure/opening lever 10, 11 is pivoted around its axis 3 in an anti-clockwise direction starting from the neutral position according to FIG. 2. As for the opening process, the stop element 11 also slides along the static conducting bolt 13 in the closure process now to be described. Thus, the stop element 11 is pivoted in the direction of the catch 1. A pivoting movement of the stop element 11 around its axis 14 in an anti-clockwise direction during transition from the neutral position according to FIG. 2 to the start of the closure position according to the illustration in FIG. 4 corresponds to this.

Thus, the stop element 11 on the lever or flat lever 10 is pivoted around its axis 14 in the direction of the catch 1 with the aid of the conducting bolt 13. Thus, the stop element 11 becomes adjacent to the stop 12 of the catch 1 with its other stop surface 11*b*, which is fitted onto the catch 1 on the other side of the pre-ratchet 16. If the spindle nut 9 is now moved further to the left starting from this position according to FIG. 4 at the start of the closure process, the stop element 11 carries the catch 1 along. The locking mechanism 1, 2 is in the pre-ratchet position in the illustration according to FIG. 4 and at the start of the closure process. The pawl 2 is consequently engaged into the pre-ratchet 16 of the catch 1. The advancing closure process during transition from FIG. 4 to FIG. 5 now leads to the catch 1 being pivoted around its axis 3 in the anti-clockwise direction indicated in FIG. 4. Thus, the pawl 2 initially engages into the main ratchet 15.

Within the scope of the execution example, the locking mechanism 1, 2 is pivoted into an overstroke position as depicted in FIG. 5 which ultimately corresponds to the closure position. In this overstroke position, the pawl 2 is a short distance from the main ratchet 15 and can engage securely. Consequently, after the end of the impingement of the motor 6 the locking mechanism 1, 2 transfers into the main ratchet position as depicted in FIG. 2. At the same time, in this process the spindle nut 9 moves back into the neutral position according to the illustration in FIG. 2. The neutral position according to FIG. 2 is also assumed again following the opening process of the spindle drive 6, 7, 8, 9 illustrated in FIG. 3.

A total of two springs 17, 18 can ensure assumption of the neutral position according to FIG. 2. The spring 17 is an opening/resetting spring 17 of the spindle drive 6, 7, 8, 9. The opening/resetting spring 17 can ensure that the spindle drive 6, 7, 8, 9 assumes the neutral position according to the illustration in FIG. 2 at least after the opening process of the locking mechanism 1, 2 according to the functional position in FIG. 3.

In contrast, the other spring 18 designed as an additional closure/resetting spring 18 can ensure that the neutral position of the spindle drive 6, 7, 8, 9 is assumed again at least after a closure process of the locking mechanism 1, 2 according to the functional process in FIGS. 4 and 5. The closure/resetting spring 18 has a considerably lower spring constant than the opening/resetting spring 17. In fact, the spring constant of the opening/resetting spring 17 may be at least two or three times as large as that of the closure/resetting spring 18.

This circumstance takes account of the fact that the closure/resetting spring 18 only needs to overcome frictional forces of the spindle drive 6, 7, 8, 9 in the transition from the closure position according to FIG. 5 to the neutral position according to FIG. 2. This primarily involves frictional forces between the spindle 8 and the spindle nut 9 located thereon. In contrast, the design of the opening/resetting spring 17 is such that this ensures and can ensure even when the spindle drive 6, 7, 8, 9 has broken down or the motor or electromotor 6 is defective or also where this is increased mechanical resistance that the spindle drive 6, 7, 8, 9 is reset purely mechanically from the opening position according to the illustration in FIG. 3 to the neutral position according to FIG. 2 in any case. This can be especially important to the extent that a closure process subsequent to the opening position according to FIG. 3 and the subsequent opening of the catch 1 wound not be possible otherwise. Because only in the neutral position according to FIG. 2 does the stop element 11 demonstrate the desired distance to the pawl 2 in such a way that it can initially engage into the pre-ratchet 15 and then into the main ratchet 16 in the relevant closure process.

In detail, the opening/resetting spring 17 according to the illustration in FIG. 1 is arranged between a stop 19 on the motor side and a stop 20 on the spindle nut side. The opening/resetting spring 17 in the execution example is a spiral-shaped coil spring which concentrically surrounds the spindle 8. Furthermore, the opening/resetting spring 17 is at least partly plunged into the gearwheel 7 or a hollow bore in the gearwheel 7 in such a way that the especially compact construction recognized in FIG. 1 is clarified inter alia. In the transition from the neutral position illustrated in FIG. 2 to the opening position according to FIG. 3, the opening/resetting spring 17 is compressed because the stop 20 on the spindle nut side is moved in the direction of the stop 19 on the motor side.

This is attributable to the fact that in the transition from the functional position in FIG. 2 to FIG. 3 the spindle nut 9 is moved to the right and consequently the stop 20 on the spindle nut side adjacent to the spindle nut 9 reduces its distance to the stop 19 on the motor side. As soon as the stop 20 on the spindle nut side is adjacent to the stop 19 on the motor side the opening movement of the spindle drive 6, 7, 8, 9 ends and the motor vehicle door latch or the spindle drive 6, 7, 8, 9 and consequently the locking mechanism 1, 2 has reached the opening position according to FIG. 3. In the opening position according to FIG. 3, the pawl 2 is lifted from its engagement with the catch 1. Consequently, the catch 1 can subsequently open in a spring-assisted manner and releases a previously caught locking bolt. A pertaining motor vehicle door is also released.

Starting from the opening position according to FIG. 3, the electromotor 6 can now be switched off. As the opening/resetting spring 17 has previously been compressed in the opening position according to FIG. 3, the absent impingement of the electromotor 6 ensures that the opening/resetting spring 17 is relaxed. This process is not influenced by the closure/resetting spring 18 because it possesses a much lower spring constant as described. The relaxed position of the opening/resetting spring 17 corresponds to the neutral position according to FIG. 2 which is consequently assumed purely mechanically by the spindle drive 6, 7, 8, 9. In this neutral position according to FIG. 2 the pawl 2 is also located in its starting position or neutral position. Consequently, the pawl 2 can easily engage into the catch 1 starting from the completely open position of the catch 1 depicted in FIG. 3 in dot dashes subsequently in a closure process.

If the spindle drive 6, 7, 8, 9 now completes a closure process in the transition to FIGS. 4 and 5 from the neutral position according to FIG. 2, the spindle nut 9 moves away from the stop 20 on the spindle nut side which it is adjacent to in the previously described opening process of the locking mechanism 1, 2. This is recognized in the transition from FIG. 2 to FIG. 4. Consequently, in the aforementioned closure process according to the illustration in FIGS. 4 and 5 only the closure/resetting spring 18 is tensioned. The closure/resetting spring 18 is a spiral spring. The closure/resetting spring 18 is connected to the end side of the spindle 8 in a torque-proof manner. Thus, rotations of the spindle 8 lead directly to the closure/resetting spring 18 being tensioned. Due to the considerably lower spring constant of the closure/resetting spring 18 compared to that of the opening/resetting spring 17, relevantly constructed spring forces have no impact with regard to the closure/resetting spring 18 on the previously described opening process and the resetting movement of the closure/opening lever 10, 11.

In contrast, the closure/resetting spring 18 starting from the closure position according to FIG. 5 ensures that the closure/opening lever 10, 11 is reset to its neutral position according to FIG. 2 when the drive ceases on the part of the electromotor 6. As the opening/resetting spring 17 remains unaffected overall, the closure/resetting spring 18 being sufficient that any frictional forces of the spindle drive 6, 7, 8, 9 are overcome.

What is claimed is:

1. A motor vehicle door latch comprising:

a locking mechanism including a catch and a pawl, a spindle drive with a motor, a spindle operable by the motor, and a spindle nut slidably movable on the spindle, and a closure lever operatively mounted to the spindle nut, the closure lever being used as a closure/opening lever to open and close the locking mechanism, wherein the spindle nut is movable between a neutral position toward a closing position in which movement of the spindle nut enables the closure/opening lever to impinge the catch in a closed direction and close the locking mechanism, or toward an opening position in which movement of the spindle nut enables the closure/opening lever to impinge the pawl in an opening direction and open the locking mechanism, wherein the closure/opening lever includes a movable member that interacts with a static conducting element to impinge the pawl or the catch.

2. The motor vehicle door latch according to claim 1, wherein the closure/opening lever includes a pivoting lever that is connected to and pivotable about a common axis of the catch.

3. The motor vehicle door latch according to claim 2, wherein the pivoting lever is connected to the spindle nut by a rotating joint at one end of the pivoting lever and the pivoting lever is connected with the catch at another end of the closure/opening lever.

4. The motor vehicle door latch according to claim 2, wherein the movable member of the closure/opening lever is a stop element pivotably located on the pivoting lever which, dependent on an actuating direction of the spindle drive either interacts with the pawl or a stop on the catch.

5. The motor vehicle door latch according to claim 4, wherein the stop element is pivoted starting from the neutral position of the spindle drive with the aid of the static conducting element according to the actuating direction of the spindle drive either in a direction toward the pawl or in a direction toward the catch around an axis of the stop element formed on the closure/opening lever.

6. The motor vehicle door latch according to claim 1, wherein the neutral position of the spindle drive is only assumed in a spring-assisted manner.

7. The motor vehicle door latch according to claim 6, wherein the spindle drive is includes at least one opening/resetting spring to assume the neutral position following an opening process of the locking mechanism.

8. The motor vehicle door latch according to claim 7, wherein the opening/resetting spring is arranged between a stop on a motor side of the spindle drive and a stop on a spindle nut side of the spindle drive.

9. The motor vehicle door latch according to claim 7 further comprising a closure/resetting spring to assume the neutral position after a closure process of the locking mechanism.

10. The motor vehicle door latch according to claim 9, wherein the opening/resetting spring has a larger spring constant than the closure/resetting spring which is at least two to three times as large.

11. The motor vehicle door latch according to claim 5 further comprising a housing, wherein the static conducting element is fixed to the housing.

12. The motor vehicle door latch according to claim 11, wherein the static conducting element is a bolt.

13. The motor vehicle door latch according to claim 12, wherein a contour of the stop element slides along the bolt when the stop element is pivoted.

14. The motor vehicle door latch according to claim 4, wherein the stop element has a first stop surface that is configured to directly contact the pawl during an opening process and a second stop surface that is configured to directly contact the catch during a closing process.

15. The motor vehicle door latch according to claim 3, wherein the pivoting lever is a flat lever having a width that extends in an actuating direction of the spindle drive.

* * * * *